US009010757B2

(12) United States Patent
Stevens Kang

(10) Patent No.: US 9,010,757 B2
(45) Date of Patent: Apr. 21, 2015

(54) TARGET AND SPHERICAL OBJECT RECEIVER

(71) Applicant: Julie A. Stevens Kang, Santa Monica, CA (US)

(72) Inventor: Julie A. Stevens Kang, Santa Monica, CA (US)

( * ) Notice: Subject to any disclaimer, the term of this patent is extended or adjusted under 35 U.S.C. 154(b) by 68 days.

(21) Appl. No.: 13/742,118

(22) Filed: Jan. 15, 2013

(65) Prior Publication Data

US 2013/0221615 A1 Aug. 29, 2013

Related U.S. Application Data

(60) Provisional application No. 61/603,241, filed on Feb. 25, 2012.

(51) Int. Cl.

| | |
|---|---|
| ***A63B 71/00*** | (2006.01) |
| ***A63B 63/00*** | (2006.01) |
| ***A63B 57/00*** | (2006.01) |

(52) U.S. Cl.

CPC ..... *A63B 63/00* (2013.01); *A63B 63/007* (2013.01); *A63B 57/0056* (2013.01); *A63B 2209/08* (2013.01); *A63B 2209/10* (2013.01); *A63B 2210/50* (2013.01)

(58) Field of Classification Search

USPC ..... 273/127 B

See application file for complete search history.

(56) References Cited

U.S. PATENT DOCUMENTS

| | | | | |
|---|---|---|---|---|
| 538,534 | A * | 4/1895 | Neil | 108/8 |
| 954,299 | A | 4/1910 | Johnson | |
| 1,297,055 | A | 3/1919 | Austin | |
| 2,236,572 | A * | 4/1941 | King | 273/127 R |
| 2,638,299 | A * | 5/1953 | Abbott | 248/181.1 |
| D174,253 | S | 3/1955 | Evans | |
| 2,899,207 | A | 8/1959 | Billinghurst | |
| D196,846 | S | 11/1963 | Niamtu | |
| 3,311,333 | A * | 3/1967 | Galloway | 52/295 |
| 3,348,797 | A * | 10/1967 | Turbyfill | 248/539 |
| 3,458,202 | A | 7/1969 | McNamara | |
| 3,661,390 | A * | 5/1972 | Cecchetti | 273/129 R |

(Continued)

FOREIGN PATENT DOCUMENTS

WO 2007/138297 A1 12/2007

OTHER PUBLICATIONS

International Search Report and Written Opinion of the International Searching Authority, International Patent Application No. PCT/US2013/021576, dated Mar. 13, 2013 (8 pages).

*Primary Examiner* — Michael Dennis
*Assistant Examiner* — Dolores Collins
(74) *Attorney, Agent, or Firm* — Michael Best & Friedrich LLP

(57) ABSTRACT

A target and object receiving device that includes a base portion having an outer edge and a lower coupling area disposed on a top surface of the base portion. An upper portion is spaced vertically from the base portion and includes an outer edge and an upper coupling area disposed on a bottom surface of the upper portion. A separator extends vertically from the lower coupling area to the upper coupling area. Either: (a) the top surface of the base portion approaches the bottom surface of the upper portion as the top surface extends from the outer edge of the base portion toward the lower coupling area; or (b) the bottom surface of the upper portion approaches the top surface of the base portion as the bottom surface of the upper portion extends from the outer edge of the base portion toward the upper coupling area.

5 Claims, 9 Drawing Sheets

(56) References Cited

U.S. PATENT DOCUMENTS

| | | | | | |
|---|---|---|---|---|---|
| 3,844,561 | A | * | 10/1974 | Renault | 273/369 |
| 3,858,888 | A | * | 1/1975 | Young | 473/186 |
| 3,891,221 | A | * | 6/1975 | Gordon | 473/174 |
| 3,909,007 | A | | 9/1975 | Wuertemburg et al. | |
| 4,066,231 | A | * | 1/1978 | Bahner et al. | 248/552 |
| 4,691,922 | A | | 9/1987 | Peel et al. | |
| 4,791,878 | A | * | 12/1988 | Lewis | 116/173 |
| 5,280,871 | A | * | 1/1994 | Chuang | 248/516 |
| 5,572,836 | A | * | 11/1996 | Parker | 52/116 |
| 5,634,733 | A | * | 6/1997 | Sperduti | 403/2 |
| D411,601 | S | | 6/1999 | Fong | |
| 6,138,978 | A | * | 10/2000 | Andersen | 248/534 |
| D442,661 | S | | 5/2001 | Young | |
| 6,924,776 | B2 | * | 8/2005 | Le et al. | 343/792.5 |
| 7,017,510 | B1 | * | 3/2006 | Nair | 116/173 |
| 7,196,674 | B2 | * | 3/2007 | Timofeev et al. | 343/810 |
| 7,246,781 | B2 | * | 7/2007 | Nam | 248/516 |
| 7,770,871 | B1 | * | 8/2010 | Swenson et al. | 254/364 |
| 8,164,536 | B2 | * | 4/2012 | Le et al. | 343/797 |
| 8,177,185 | B2 | * | 5/2012 | Priegel | 248/539 |
| 8,272,969 | B2 | * | 9/2012 | Priegel | 473/176 |
| 2002/0193172 | A1 | * | 12/2002 | Fuller | 473/195 |
| 2005/0110699 | A1 | * | 5/2005 | Timofeev et al. | 343/797 |

* cited by examiner $x > d$
$y \leq d$

TARGET AND SPHERICAL OBJECT RECEIVER

CROSS-REFERENCE TO RELATED APPLICATIONS

This application claims the benefit of U.S. Provisional Application Ser. No. 61/603,241 filed Feb. 25, 2012, entitled "Ball and Marble Receiver," which is incorporated herein by reference in its entirety.

TECHNOLOGY FIELD

The present invention relates in general to a device used for sports and recreation and more particularly, to a device and method for providing a target and receiving a spherical object, such as a ball or marble.

BACKGROUND

Various sports and recreation activities, such as golf, soccer, marbles, billiards, tennis, etc., include propelling a spherical object toward a desired target (e.g., hole, flag, net, area on a surface). For example, golf includes propelling (e.g., chipping and putting) a spherical golf ball toward a hole or cup. Most players of these sports and recreation activities strive to improve their skill levels through practice.

Practicing these sports, however, may be time consuming, expensive and cumbersome. For example, some sports and recreation activities require traveling to a practice facility (e.g., golf course or driving range, tennis court, soccer field, and the like) and paying for the use of the practice facility. Other sports and recreation activities, such as marbles, may require setting up targets (e.g., other marbles) and retrieving the other targets when they are struck by the propelled object. Accordingly, a more cost effective and less cumbersome target and receiving device is needed.

SUMMARY

Embodiments of the present invention are directed to a target and object receiving device that includes a base portion, an upper portion and a separator. The base portion includes a base portion outer edge defining an outer perimeter of the base portion and a lower coupling area disposed on a top surface of the base portion. The upper portion is spaced vertically from the base portion and includes an upper portion outer edge defining a perimeter of the upper portion and an upper coupling area disposed on a bottom surface of the upper portion. The separator extends vertically from the lower coupling area to the upper coupling area.

In one embodiment, either the top surface of the base portion is curved or the bottom surface of the upper portion is curved.

According to an embodiment, the target and object receiving device further includes one or more coupling mechanisms configured to couple the base portion, the upper portion and the separator.

In an aspect of the embodiment, the one or more coupling mechanisms include a fastening device extending vertically through the base portion, the upper portion and the separator.

According to one embodiment, the base portion, the upper portion and the separator are rigidly attached.

According to another embodiment, the base portion, the upper portion and the separator are removably coupled.

In one embodiment, at least one of: (i) the bottom surface of the upper portion includes a bottom surface friction portion configured to increase friction between the friction portion and a spherical object contacting the friction portion; and (ii) the top surface of the base portion includes a top surface friction portion configured to increase friction between the spherical object contacting the friction portion.

According to an aspect of an embodiment, at least one of the bottom surface friction portion and the top surface friction portion include one or more friction materials selected from rubber, felt, high friction polymer, cork, foam, silicone, carpet material, cardboard, polyurethane, fabric, vinyl and textured metal.

According to one embodiment, the target and object receiving device further includes a customized target display object extending vertically from the top surface of the upper portion and configured to display predetermined customized information.

In an aspect of an embodiment, the target display object is removably coupled to the top surface of the upper portion. In another aspect of an embodiment, the target display object includes at least one flag pole portion and a flag coupled to the at least one flag pole portion and having the predetermined customized information.

Embodiments of the present invention are directed to a target and object receiving device that includes a base portion, an upper portion and a center axis. The base portion includes a base portion edge defining an outer perimeter of the base portion and a base portion top surface extending from the base portion outer edge toward a receiving device center axis. The upper portion includes an upper portion outer edge defining a perimeter of the upper portion and an upper portion bottom surface facing the top surface of the base portion and extending from the upper portion outer edge toward the receiving device center axis. Either: (a) the base portion top surface approaches the upper portion bottom surface as the base portion top surface extends from the outer edge of the base portion toward the receiving device center axis; or (b) the upper portion bottom surface approaches the base portion top surface as the upper portion bottom surface extends from the outer edge of the base portion toward the receiving device center axis. The base portion top surface and the upper portion bottom surface are configured to stop a spherical object between the base portion top surface and the upper portion bottom surface when a portion of the spherical object passes between the base portion top surface and the upper portion bottom surface.

According to an embodiment, either the top surface of the base portion is curved or the bottom surface of the upper portion is curved.

In one embodiment, the base portion and the upper portion are unitarily formed. In an aspect of an embodiment, the base portion and the upper portion form a continuous surface having opposing top and bottom surface portions that are curved to stop the spherical object.

According to another embodiment, the target and object receiving device further includes a customized target display object extending vertically from the upper portion and configured to display predetermined customized information. In one aspect of an embodiment, the target display object is removably coupled to the top surface of the upper portion.

Embodiments of the present invention are directed to a target and object receiving device that includes a base portion including a base portion edge defining an outer perimeter of the base portion and a base portion top surface extending from the base portion outer edge toward a receiving device center axis. The target and object receiving device also includes an upper portion including an upper portion outer edge defining a perimeter of the upper portion and an upper portion bottom surface facing the top surface of the base portion and extending from the upper portion outer edge toward the receiving device center axis. The target and object receiving device further includes a customized target display object extending vertically from the upper portion and configured to display predetermined customized information. Either: (a) the base portion top surface approaches the upper portion bottom surface as the base portion top surface extends from the outer edge of the base portion toward the receiving device center axis; or (b) the upper portion bottom surface approaches the base portion top surface as the upper portion bottom surface extends from the outer edge of the base portion toward the receiving device center axis. The base portion top surface and the upper portion bottom surface are configured to stop a spherical object between the base portion top surface and the upper portion bottom surface when a portion of the spherical object passes between the base portion top surface and the upper portion bottom surface.

According to an embodiment, the target display object is removably coupled to the top surface of the upper portion.

According to another embodiment, the target display object includes at least one flag pole portion and a flag coupled to the at least one flag pole portion and having the predetermined customized information.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF ILLUSTRATIVE EMBODIMENTS

Embodiments of the present invention provide a cost effective and portable target and receiving device to practice a variety of sports and activities that include propelling spherical objects, such as golf balls, marbles, etc., toward a target. Embodiments of the present invention provide a target and spherical object receiving device configured to stop a spherical object between a base portion and an upper portion when the spherical object passes between the base portion and the upper portion. Embodiments of the present invention utilize curved surfaces on at least one of the base portion and an upper portion to stop a spherical object between the base portion and the upper portion. Embodiments of the present invention stop spherical objects that may be received from directions in 360 degrees. While the objects are generally spherical in shape, the object may or may not have a smooth outer surface. For example, one suitable spherical object for use with the target and receiving device is a golf ball that has a general spherical shape and also includes dimples in its outer surface.

Figure 1:
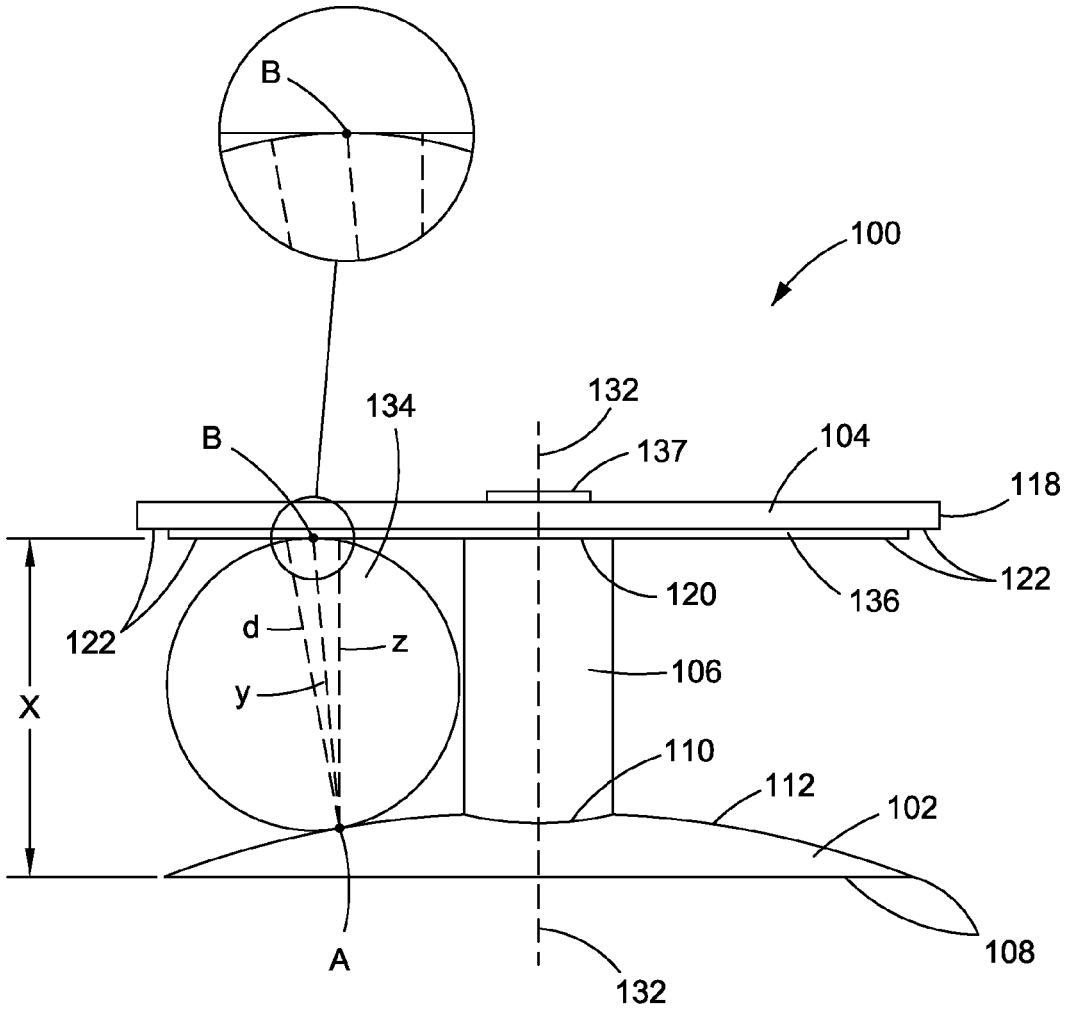
FIG. 1 is a side view of an exemplary target and spherical object receiving device that can be used with embodiments disclosed herein.
Figure 2A:
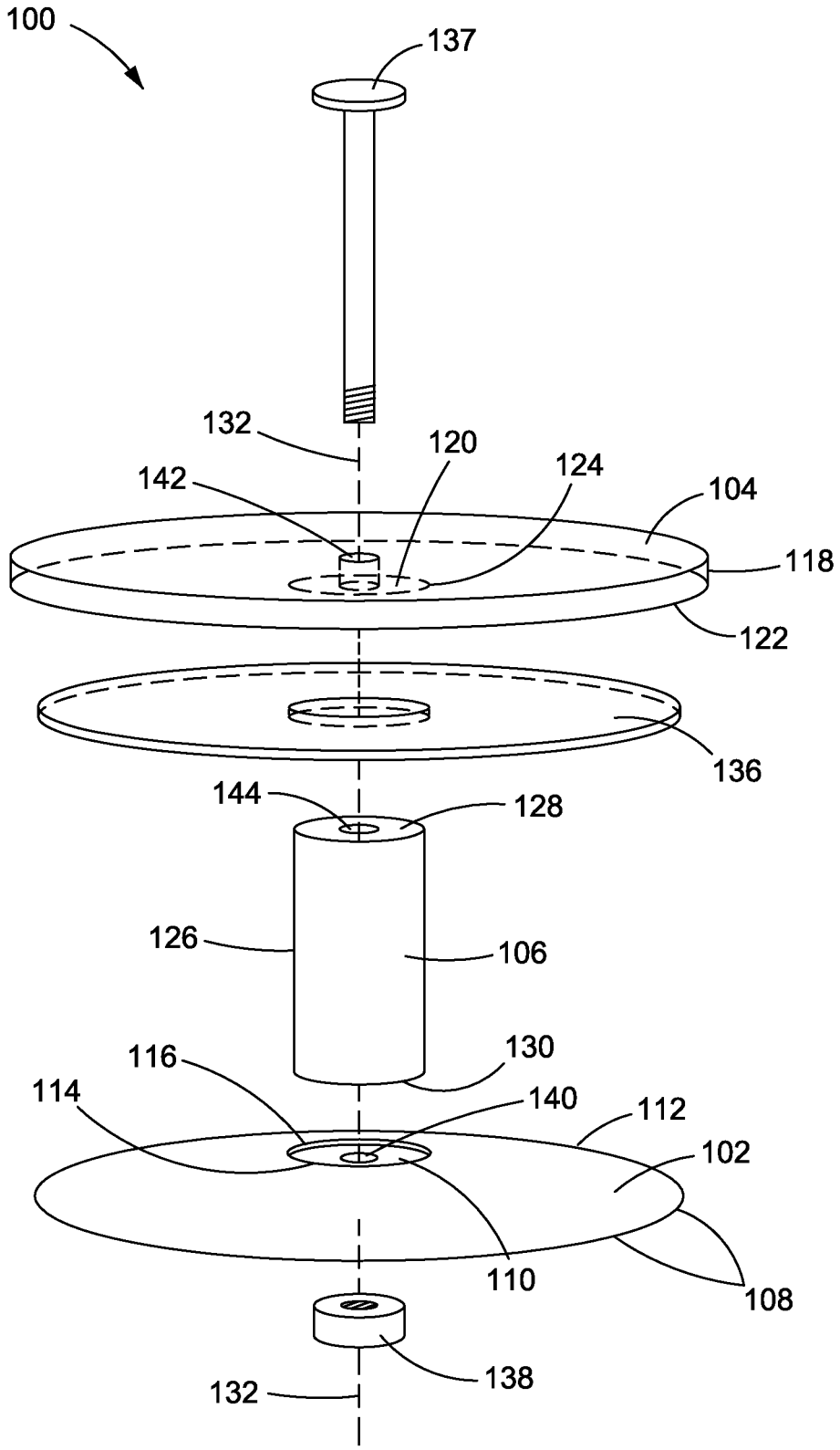
FIG. 2A is an exploded view of the exemplary target and spherical object receiving device shown at FIG. 1.
Figure 2B:
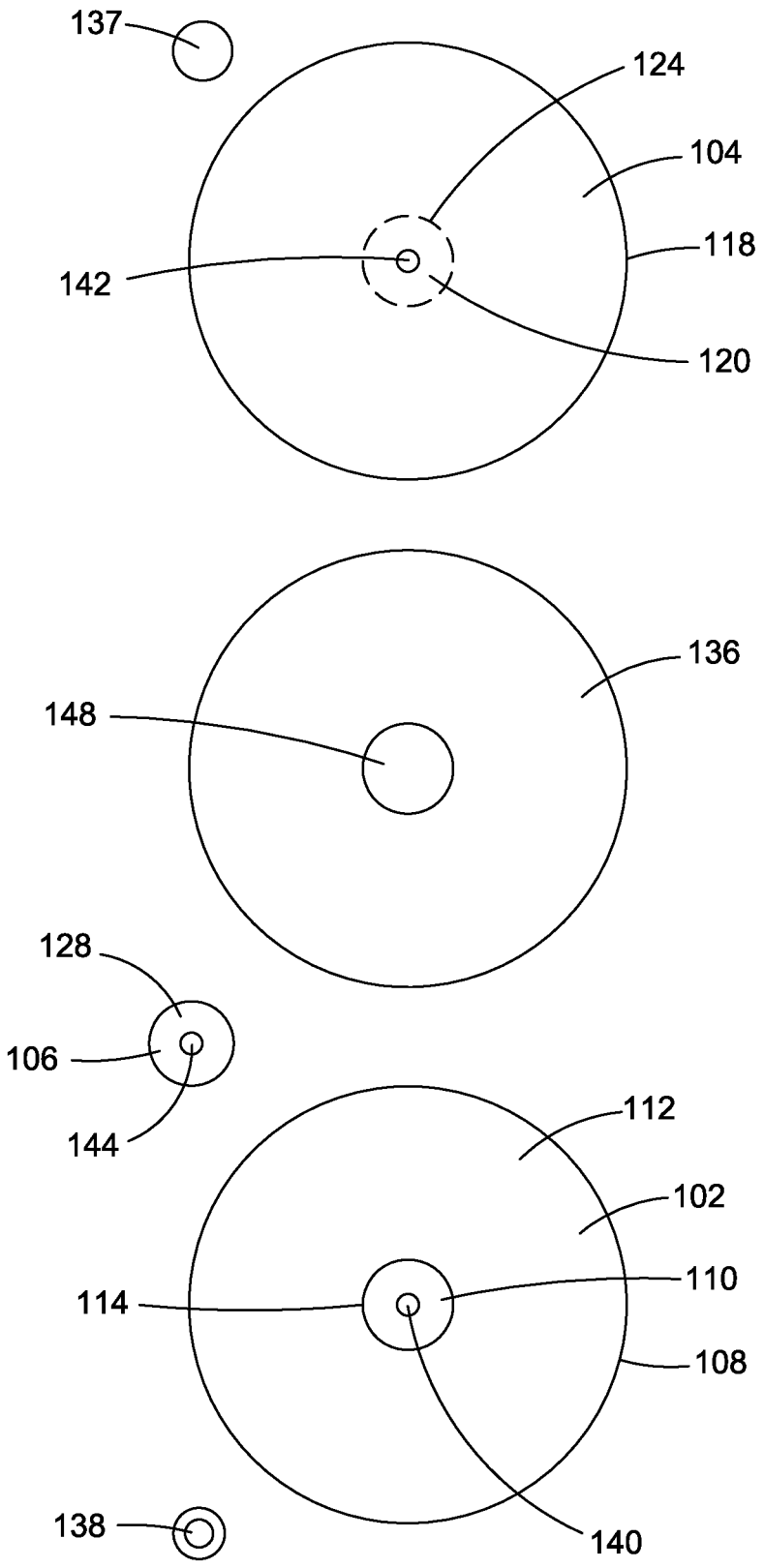
FIG. 2B shows top views of components of the exemplary target and spherical object receiving device shown at FIG. 1.

FIG. 1 is a side view of an exemplary target and spherical object receiving device 100 that can be used with embodiments disclosed herein. FIG. 2A is an exploded view of the exemplary target and spherical object receiving device shown at FIG. 1. FIG. 2B shows top views of components of the exemplary target and spherical object receiving device shown at FIG. 1. The target and spherical object receiving device 100 will now be described with reference to FIG. 1, FIG. 2A and FIG. 2B.

As shown at FIG. 1, FIG. 2A and FIG. 2B, the target and spherical object receiving device 100 may include a base portion 102, an upper portion 104 and a cylindrical separator 106. In the embodiments shown at FIG. 1, FIG. 2A and FIG. 2B, base portion 102 and upper portion may be circular and target and spherical object receiving device 100 may include a center axis 132 extending vertically through the base portion 102, the upper portion 104 and the cylindrical separator 106. For example, the base portion 102 may include a circular outer edge 108 defining an outer circumferential perimeter of the base portion 102 and the upper portion 104 may include a circular outer edge 118 defining a circumferential perimeter of the upper portion 104. This embodiment may be advantageous because the target and spherical object receiving device 100 may receive a spherical object from 360 degrees. In other embodiments, however, base portions and upper portions may have different geometries, including non-circular and irregularly shaped geometries (e.g., shaped as a green on a golf course).

The base portion 102 may also include a lower coupling area 110 configured to be coupled to cylindrical separator 106. Lower coupling area 110 may be disposed on a top surface 112 of the base portion 102 and have a lower coupling area perimeter 114. As shown at FIG. 1, the lower coupling area 110 may be a lower central area that is centered on top surface 112 of the base portion 102 and has a circumferential perimeter. In some embodiments, however, lower coupling areas may not be centered on top surfaces of base portions and may have different geometries. Top surface 112 may extend from the base portion circular outer edge 108 toward lower coupling area 110.

The upper portion 104 may also include an upper coupling area 120 configured to be coupled to a separator, such as cylindrical separator 106. Upper coupling area 120 may be disposed on the bottom surface 122 of the upper portion 104 and having an upper coupling area perimeter. As shown at FIG. 1, the upper coupling area 120 may be a central area that is centered on bottom surface 122 of the upper portion 104 and has a circumferential perimeter 124. In some embodiments, however, upper coupling areas may not be centered on bottom surfaces of upper portions and may have different geometries. As shown at FIG. 1, bottom surface 122 may extend from the upper portion circular outer edge 118 toward upper coupling area 120.

In some embodiments, coupling areas may be offset from their respective surfaces. For example, the lower coupling area 110 may be offset (e.g., recessed) from the top surface 112 (as shown at FIG. 2A) and may include an inner wall 116 which defines the central area circumferential perimeter 114. The inner wall 116 may, for example, be used to support the cylindrical separator 106.

In the embodiments shown at FIG. 2A and FIG. 2B, the central circumferential perimeter 124 of the circular upper central area 120 may be the same as the central circumferential perimeter 114 of the circular lower central area 110, thereby defining a common central area circumferential perimeter. The upper portion 104 may also include a bottom surface 122 facing the top surface 112 of the base portion 102. Bottom surface 122 may extend from the upper portion circular outer edge 118 toward the center axis 132.

As shown at FIG. 1, the upper portion 104 may be spaced vertically from the base portion 102 via a cylindrical separator 106. The cylindrical separator 106 may extend vertically from the circular lower central area 110 to the circular upper central area 120, thereby creating a space for receiving a spherical object, such as spherical object 134, between the bottom surface 122 of the upper portion 104 and the top surface 112 of the base portion 102. As shown in the embodiment at FIG. 1 and FIG. 2A, the cylindrical separator 106 may be a right circular cylinder having the circumferential perimeter 126 remain constant as it extends vertically from the circular lower central area 110 to the circular upper central area 120. The circumferential perimeter 126 at the top surface 128 of the cylindrical separator 106 may be substantially equal to the circumferential perimeter 124 of the circular upper central area 120 and the circumferential perimeter 126 at the bottom surface 130 of the cylindrical separator 106 may be equal to the circumferential perimeter 114 of the circular lower central area 110.

Although the separator 106 shown in the embodiment at FIG. 1, FIG. 2A and FIG. 2B is cylindrical, other embodiments may include separators having other geometries, including separators which are not cylindrical (e.g., X-shaped). In some aspects, separators may be flexible.

In some embodiments, one or more portions of the target and object receiving device 100 may be removably coupled by one or more coupling mechanisms 137, 138. In some aspects, the one or more coupling mechanisms 137, 138 may be configured to couple the base portion, the upper portion and the cylindrical separator. For example, as shown at FIG. 1 and FIG. 2A, the one or more coupling mechanisms may include one or more fastening devices, such as bolt 137, extending vertically through hole 140 of the base portion 102, hole 142 in the upper portion 104 and hole 144 in the cylindrical separator 106. The one or more coupling mechanisms may also include nut 138. The bolt 137 may be threaded (e.g., clockwise) into nut 138 to couple and secure the base portion 102, the upper portion 104 and the cylindrical separator 106 and may be unthreaded (e.g., counter-clockwise) to disassemble the target and object receiving device 100 or to adjust the distance between the base portion 102 and the upper portion 104. In some embodiments, one or more portions (e.g., base portion 102, upper portion 104 and cylindrical separator 106) of the target and object receiving device 100 may be rigidly attached. Coupling mechanisms may include other types of devices such as hardware (e.g., screws, pins) and magnetic devices (magnets).

Figure 4:
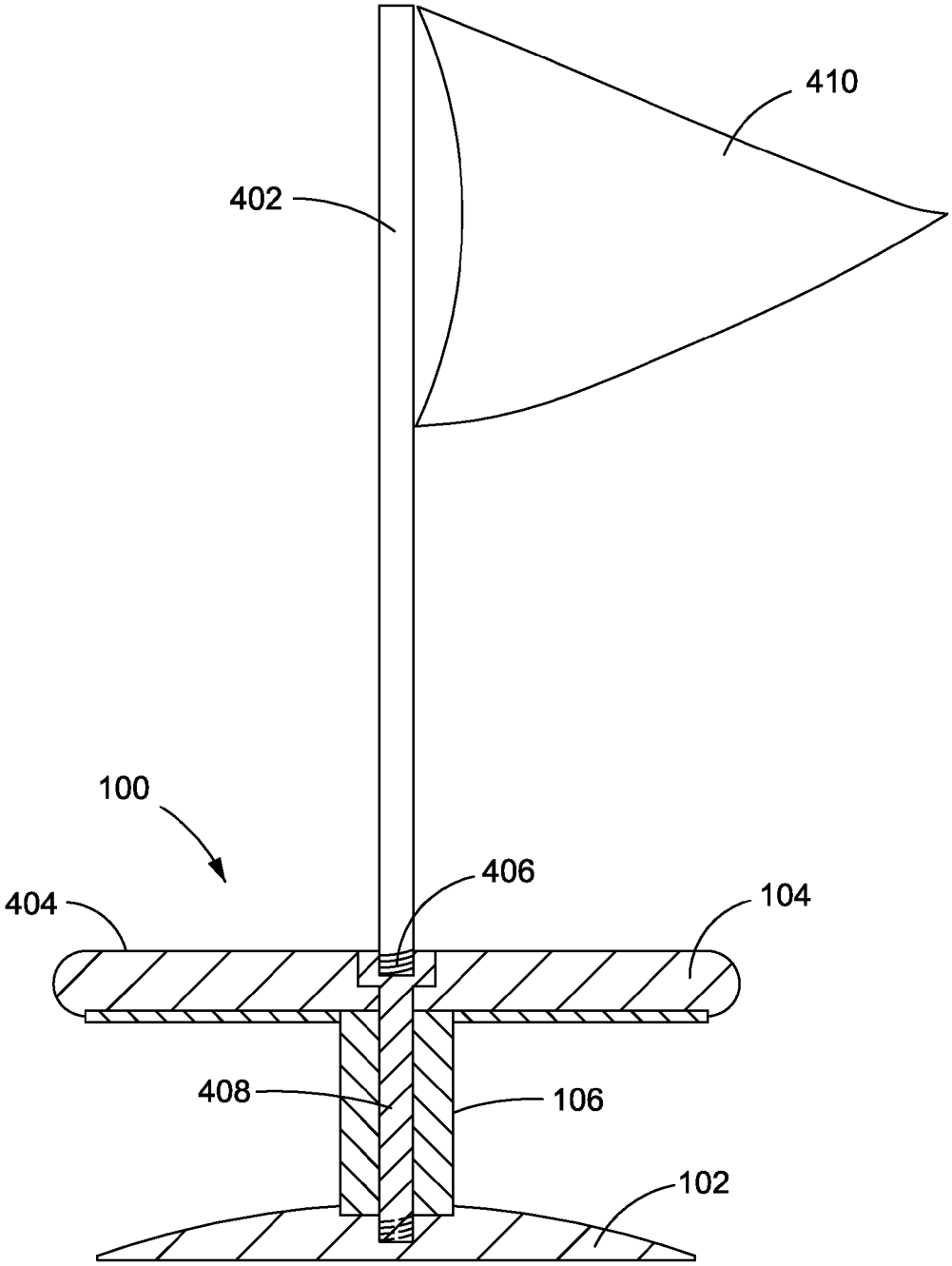
FIG. 4 is a cross sectional view of an exemplary target and spherical object receiving device having a target flag that can be used with the embodiments disclosed herein.
Figures 8A, 8B:
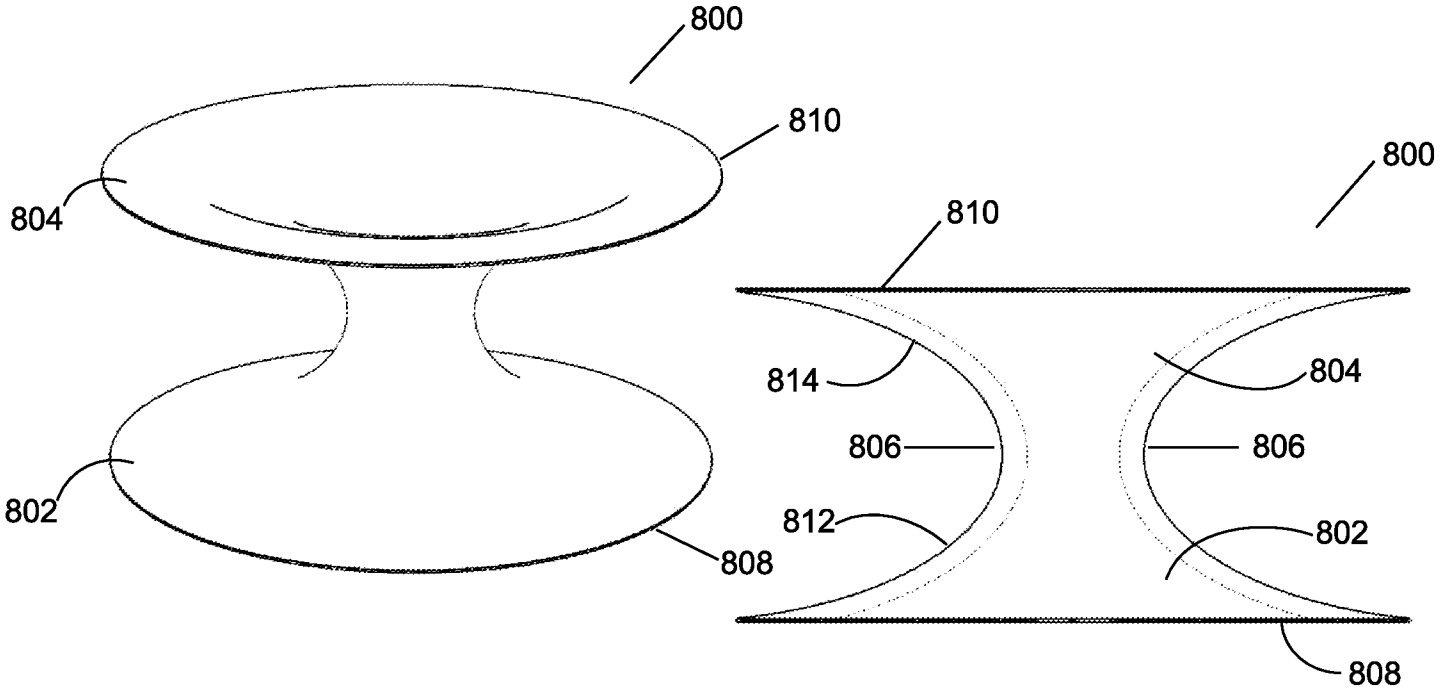
FIG. 8A is a perspective view of an exemplary unitarily formed target and spherical object receiving device that can be used with embodiments disclosed herein.
FIG. 8B is a side view of the exemplary unitarily formed target and spherical object receiving device shown at FIG. 8A.

In some embodiments, base portions and/or upper portions may be solid and coupling mechanism may be coupled directly to the base portions and/or upper portions (e.g., without using nuts). For example, as shown at FIG. 4, bolt 408, may be threaded directly into solid base portion 102. In some embodiments, components of target and object receiving devices may be integral (e.g., not removable) to each other. In some embodiments, for example, as shown at FIG. 8A and FIG. 8B target and object receiving devices may be unitarily formed. As shown, lower portion 802 and upper portion 804 may be unitarily formed together, thereby providing a continuous surface 806 extending between a bottom edge 808 and a top edge 810 of the target and object receiving device 800. Continuous surface 806 may include opposing surface portions 812 and 814 which may be curved to stop spherical objects 134 between bottom edge 808 and top edge 810.

In some embodiments, the separator may include a fastening mechanism with a spacer or notches that force the upper and lower portions to remain a predetermined distance from each other. In some embodiments, the separator may be configured (e.g., threaded, notches, pins, sliding portions, and the like) to adjust the receiving area between base portions and upper portions to allow use with different spherical object sizes. Although the lower central area 110 and the upper central area 120 shown in this embodiment are circular, other embodiments may include lower central areas and upper central areas having different shapes and sizes. Some embodiments may not comprise any lower central areas or upper central areas.

In some embodiments, upper portions, lower portions and separators may be made of low friction materials, such as metallic materials, low friction rubber, plastic, wood, silicone, cardboard, stone, ceramic, glass and resin. Base portions 102 and/or upper portions 104 may include friction portions made of high friction materials configured to increase the friction between the spherical object 134 and the respective friction portions 136. For example, as shown at the embodiment at FIG. 1, upper portion 104 may include a friction portion 136 configured to increase friction between the friction portion 136 of the upper portion 104 and the spherical object 134 contacting the friction portion 136. In some embodiments, the top surface 112 of the base portion 102 may include a friction portion (not shown) configured to increase friction between a friction portion (not shown) and the spherical object 134. In some embodiments, both bottom surface 122 of the upper portion 104 and the top surface 112 of base portion 102 may include a friction portion. For example, as shown at FIG. 1, the bottom surface 122 of the upper portion 118 extends along the bottom of the friction portion 136. In the embodiment shown at FIG. 1, the friction portion 136 does not extend to the outer edge 118 of the top portion 104. In other embodiments, friction portions may extend to the outer edges of upper and/or base portions. Friction portions 136 may include one or more friction materials selected from rubber, felt, high friction polymer, cork, foam, silicone, carpet material, cardboard, polyurethane, fabric, vinyl, textured metal, and any other material configured to increase the friction between the spherical object 134 and the respective friction portions 136. In some embodiments, upper portions, lower portions and separators may include the one or more friction materials, and separate one or more friction portions may not be needed.

Figure 3:
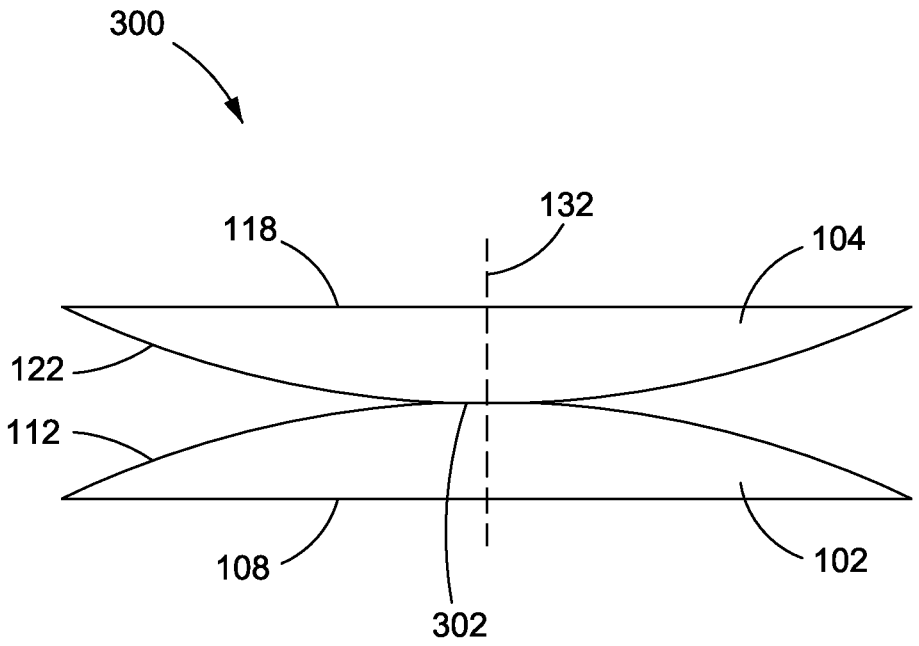
FIG. 3 is a side view of an exemplary target and spherical object receiving device having a base portion and a upper portion meeting at an inner edge that can be used with the embodiments disclosed herein.

According to varying embodiments, top surfaces of base portions and bottom surfaces of the upper portions may include different configurations to stop spherical objects between top surfaces and bottom surfaces when portions of the spherical objects pass between the top surfaces and the bottom surfaces. For example, in the embodiment shown at FIG. 1, top surfaces 112 of base portions 102 may be curved to stop spherical objects 134 between top surfaces 112 and bottom surfaces 122. The top surface 112 of base portion 102 slopes or curves toward the bottom surface 122 of the upper portion 104 while the bottom surface 122 of the upper portion 104 does not slope or curve toward the top surface 112 of base portion 102. That is, the top surface 112 of base portion 102 approaches the bottom surface 122 of the upper portion 104 as the top surface 112 extends from the circular outer edge 108 of the base portion 102 toward the circular lower central area 110 while the bottom surface 122 of the upper portion 104 remains level. In some embodiments, the bottom surface 122 of the upper portion 104 may be configured to slope or curve toward the top surface 112 of base portion 102 while the top surface 112 of base portion 102 remains level. In some embodiments both bottom surface 122 of the upper portion 104 and the top surface 112 of base portion 102 may be curved or sloped toward each other. For example, as shown at FIG. 3, both bottom surface 122 of the upper portion 104 and top surface 112 of base portion 102 include surfaces which slope toward each other as they extend toward center axis 132. In some embodiments, both the bottom surface 122 of the upper portion 104 and top surface 112 of base portion 102 may be sloped, but the slopes may be different from each other. For example, the bottom surface 122 may have a steeper slope than the top surface 112. In the embodiment shown at FIG. 8A and FIG. 8B, surface portions 812 and 814 of continuous surface 806 may be curved to stop spherical objects 134.

For simplification, an embodiment with dimensions of components and distances between components with reference to FIG. 1 will now be described for use with a golf ball as the spherical object 134 having a diameter of about 1.68 inches. It is to be understood, however, that other spherical objects may be used and the dimensions of the components and the distances between components of target and object receiving devices may vary depending on the type of spherical object that a particular target and object receiving devices is configured to receive. For further simplification, this embodiment will now be described with a curved top surface 112 of the base portion 102 and a level bottom surface 122 of the upper portion 104. It is to be understood, however, that the dimensions of the components and the distances between the components of target and object receiving devices may vary depending on whether one or more of the top surface and bottom surface is curved.

According to the embodiment, the top surface 112 of the base portion 102 and the bottom surface 122 of the upper portion 104 may be configured to stop the golf ball 134 passing between the top surface 112 of the base portion 102 and the bottom surface 122 of the upper portion 104 by decreasing a distance between the top surface 112 of the base portion 102 and the bottom surface 122 of the upper portion 104 until the distance between a point A on the top surface of the base portion 102 and a point B on the bottom surface of the upper portion 104 is equal to or less than the diameter d of the spherical object 134.

As shown at FIG. 1, the distance between the top surface 112 of base portion 102 and the bottom surface 122 of upper portion 104 is decreased by sloping the top surface 112 of base portion 102 toward the bottom surface 122 of the upper portion 104. The distance between the top surface 112 of base portion 102 and the bottom surface 122 of upper portion 104 may also be decreased by curving (e.g., increasing the slope) the top surface 112 of base portion 102. As shown at FIG. 1, the vertical distance x between the top surface 112 and the bottom surface 122 at the outer edge 108 of the base portion 102 is greater than the diameter d of the golf ball 134, thereby allowing the golf ball 134 to contact and move along the top surface 112 without being impeded by bottom surface 122. As the top surface 112 of the base portion 102 and the bottom surface 122 of the upper portion 104 extend toward the center axis 132, the distance between the top surface 112 and the bottom surface 122 continually decreases to a vertical distance z that is equal to the diameter of the golf ball 134. The golf ball 134 contacts top surface 112 at point A and contacts bottom surface 122 at point B, as shown at FIG. 1. Because the top surface 112 has a slope different than the outside surface of the golf ball, the straight line distance y between point A and point B is offset from vertical and is less than diameter d of the golf ball 134.

Accordingly, a target and object receiving device 100 may be configured so that the diameter d is equal to 1.68 inches between a point of contact (e.g., point A) along the top surface 112 and a point of contact (e.g., point B) along the bottom surface 122. The points of contact may be arranged along the top surface 112 and bottom surface 122 via the particular dimensions of any of: the top surface 112; the bottom surface 122; the cylindrical separator 106; the upper portion 104; and the base portion 102. For example, in the embodiment for use with a golf ball, points of contact along the top surface 112 and bottom surface 122 may be arranged to stop the golf ball 134 between the top surface 112 and bottom surface 122 when the curved top surface 112 of the base portion includes a radius of 16 inches, the diameter of the cylindrical separator 106 is ⅞ inches, the height of the cylindrical separator 106 is 1½ inches, the diameter of the base portion 102 is 4 15/16 inches and the height of the base portion 102 increases from 0 inches to ⅜ inches. These dimensions are merely exemplary. The points of contact may be arranged along the top surface 112 and bottom surface 122 by changing any one or a combination of the dimensions of various components of a target and object receiving device 100. For example, the diameter of the base portion 102 may be configured to be is 4¼ inches to simulate putting at a regulation golf hole.

In the embodiment shown at FIG. 1, FIG. 2A and FIG. 2B, the circumferential perimeter of the base portion 102 and the circumferential perimeter of the upper portion 104 are substantially the same. In other embodiments, however, the circumferential perimeters of base portions and upper portions may be different from each other. In some embodiments, the circumferential perimeters of base portions and upper portions and their comparative sizes to each other may be based on predicted end uses, ball types and ball sizes.

In some embodiments, a target and spherical object receiving device 300 may not include a separator, such as cylindrical separator 106 shown at FIG. 1. For example, as shown at FIG. 3, bottom surface 122 of the upper portion 104 and top surface 112 of base portion 102 join at a common edge 302. According to some aspects of this embodiment, top surfaces 112 of base portions 102 and/or bottom surfaces 122 of upper portions 104 may be curved or sloped to stop spherical objects 134. For example, as shown at FIG. 3, the top surface 112 of the base portion 102 may be arranged to approach the bottom surface 122 of the upper portion 104 as the top surface 112 extends from the circular outer edge 108 toward the center axis 132 and the bottom surface 122 of the upper portion 104 may be arranged to approach the top surface 112 of the base portion 102 as the bottom surface 122 extends from the circular outer edge 118 of the base toward the center axis 132.

In some embodiments, as shown at FIG. 4, the target and object receiving device 100 may include a customized target display object, such as flag 410, configured to display predetermined customized information and/or create an enhanced visual target. Customized target display objects may include any type of object that may be used to display customized information, such as flags, banners, pennants, signs, and the like. Predetermined customized information may be selected from a group of information that includes but not limited to logos, symbols, images, one or more alphanumeric characters, alphanumeric combination, and colors. In some aspects, predetermined customized information may be associated with a school (e.g., high school, university) a professional sports team (e.g., a team nickname or city).

Figure 5:
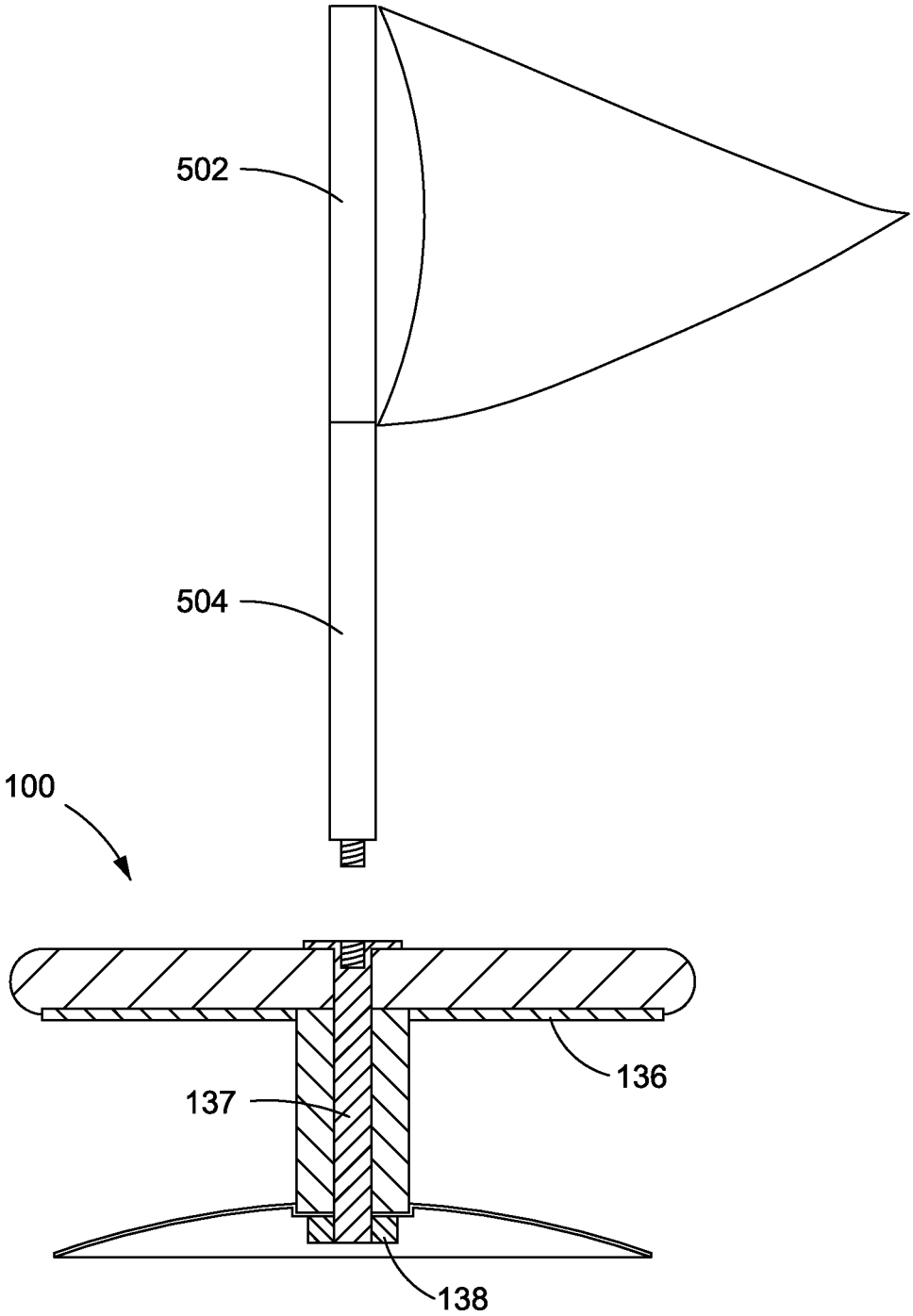
FIG. 5 is a cross sectional view of an exemplary target and spherical object receiving device having a multiple section target flag that can be used with the embodiments disclosed herein.

The customized target display object may also include a mounting portion such as flag pole 402. As shown at FIG. 4, flag pole 402 may extend vertically from the upper portion and may be coupled to a top surface 404 of the upper portion 104. As shown at FIG. 4, the flag pole 402 extends vertically up from the top surface 402 of the upper portion 104. The flag pole 402 may be removably coupled to the target and object receiving device 100 by various mechanical devices. For example, as shown at FIG. 4, flag pole 402 may be coupled to coupling device 408 via threads 406 and bolt 408 may be threaded directly into solid base portion 102. Flag pole 402 may also be coupled to the target and object receiving device 100 via other mechanical devices, friction fitting, gravity, or magnets. As shown at FIG. 5, the flag pole may be threaded directly into the coupling mechanism 137 which may be secured by nut 138. As shown at FIG. 5, in some aspects, the flag pole 402 may include multiple flag pole portions 502 and 504.

Figure 6:
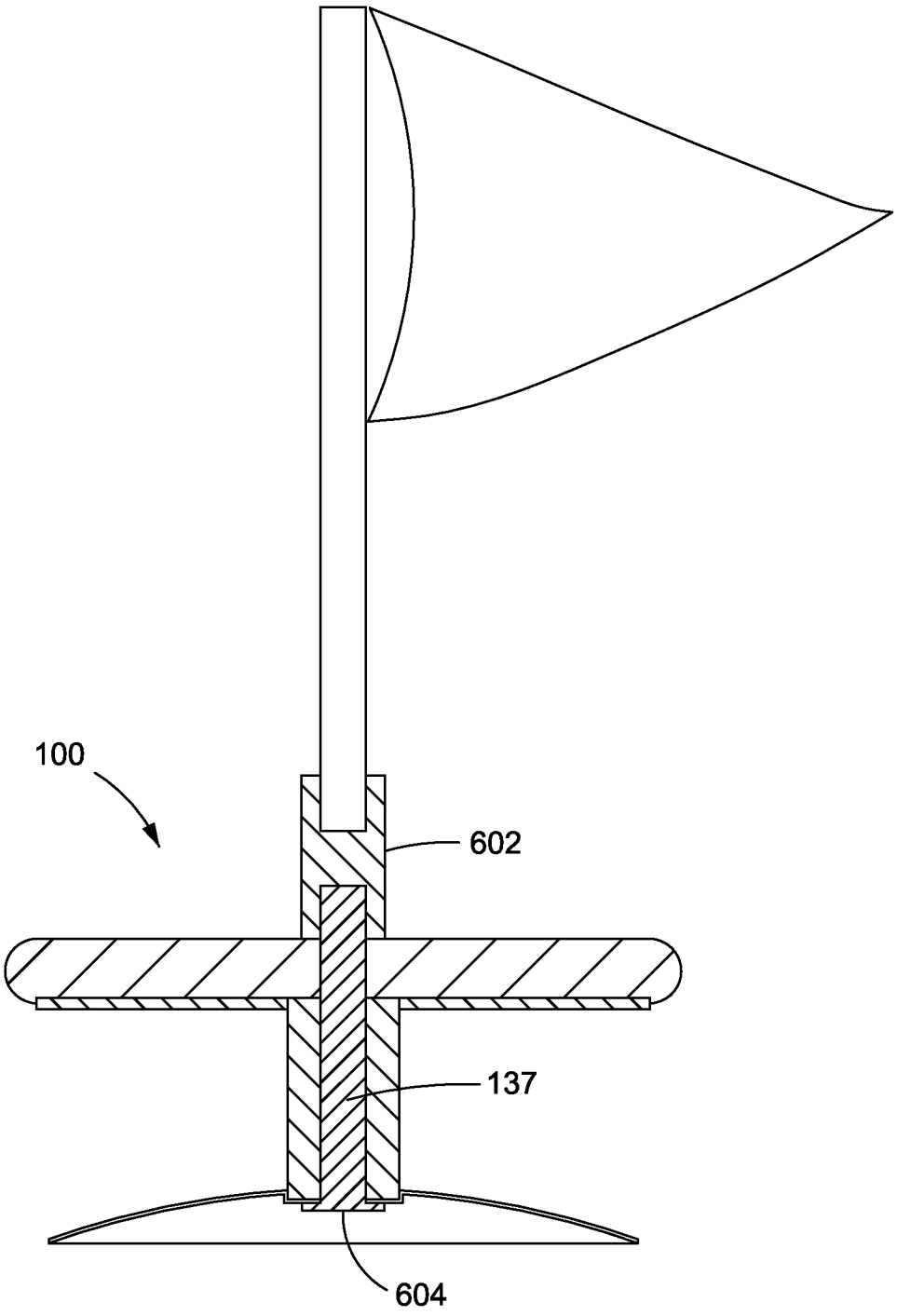
FIG. 6 is a cross sectional view of an exemplary target and spherical object receiving device having a multiple section target flag that can be used with the embodiments disclosed herein.

As shown at FIG. 6, the flag pole 402 may be coupled to the target and object receiving device 100 via a second coupling device 602. Coupling device 602 may be used to couple the flagpole 602 to bolt 137. As shown at FIG. 6, bolt 137 may also be inverted from its position at FIG. 1 as it extends vertically upward through the base portion 102, upper portion 104 and cylindrical separator 106.

Figure 7:
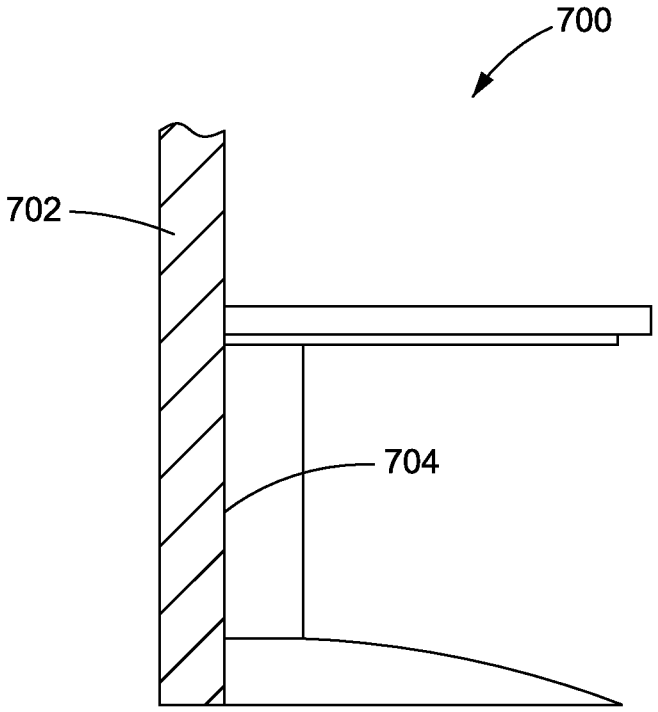
FIG. 7 is a side view of an exemplary semi-circular target and spherical object receiving device having a flat side outer edge abutting a wall that can be used with the embodiments disclosed herein.

Embodiments described above allow spherical objects to be propelled toward object receiving devices from 360 degrees. In some embodiments, however, it may be desirable to place object receiving devices against a background object, such as a wall. FIG. 7 is a side view of an exemplary target and spherical object receiving device 700 having a flat side edge 704, which may be placed against a background object 702. As shown at FIG. 7, the target and spherical object receiving device 700 is half of the target and spherical object receiving device 100 shown at FIG. 1. The background object 702 may be used to stop the spherical object 134 if the spherical object 134 misses the target.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A target configured to stop and capture a separate moving spherical object, the target comprising:

a base portion including:

a substantially inclined upper surface;

a base portion outer edge defining an outer perimeter of the base portion;

a lower coupling area located at the top surface of the base portion;

an upper portion spaced vertically from the base portion, the upper portion including:

a substantially planar lower surface;

an upper portion outer edge defining a perimeter of the upper portion; and an upper coupling area located at the bottom surface of the upper portion;

a separator extending vertically between and at least partially received within the lower coupling area and the upper coupling area;

a pole extending from the upper portion to produce a distal end, wherein the pole is formed from two or more pole portions and adapted to hold a flag or marker;

a fastener extending through the base portion, through the upper portion, and through the separator to be removably coupled to the pole;

wherein the top surface of the base portion approaches the bottom surface of the upper portion as the top surface extends radially inwardly from the outer edge of the base portion toward the lower coupling area; and wherein the base portion top surface and the upper portion bottom surface are configured to stop and capture the separate moving spherical object therebetween when the spherical object is directed toward the target and at least a portion of the spherical object passes between the base portion top surface and the upper portion bottom surface.

2. The device of claim 1, wherein the base portion top surface is treated to increase the friction between the separate spherical object and the base portion top surface.

3. The device of claim 1, wherein the upper portion bottom surface is treated to increase the friction between the separate spherical object and the upper portion bottom surface.

4. The device of claim 1, wherein the base portion top surface and the upper portion bottom surface are configured to capture a golf ball.

5. The device of claim 1, wherein the upper portion bottom surface and the base portion top surface are treated to increase the friction between the spherical object and the surfaces.

* * * * *